US006433490B2

(12) United States Patent
Koch et al.

(10) Patent No.: US 6,433,490 B2
(45) Date of Patent: Aug. 13, 2002

(54) ELECTRONIC BALLAST FOR AT LEAST ONE LOW-PRESSURE DISCHARGE LAMP

(75) Inventors: Stefan Koch; Günter Marent, both of Dornbirn (AT)

(73) Assignee: Tridonic Bauelemente GmbH, Dornbirn (AT)

( * ) Notice: Subject to any disclaimer, the term of this patent is extended or adjusted under 35 U.S.C. 154(b) by 0 days.

(21) Appl. No.: 09/766,611

(22) Filed: Jan. 23, 2001

Related U.S. Application Data

(63) Continuation of application No. PCT/EP00/03572, filed on Apr. 19, 2000.

(30) Foreign Application Priority Data

May 25, 1999 (DE) ..... 199 23 946
Jul. 23, 1999 (DE) ..... 199 34 687

(51) Int. Cl.[7] ..... H05B 37/00

(52) U.S. Cl. ..... 315/224; 315/106; 315/219; 315/276

(58) Field of Search ..... 315/224, 219, 315/276, 106

(56) References Cited

U.S. PATENT DOCUMENTS 4,481,460 A 11/1984 Kröning et al. ..... 323/266
5,550,433 A 8/1996 Tobler ..... 315/94
5,656,891 A 8/1997 Luger et al. ..... 315/94
5,796,213 A * 8/1998 Kawasaki ..... 315/209 R
5,854,538 A 12/1998 Krummel ..... 315/105

FOREIGN PATENT DOCUMENTS

DE 29514817 U1 1/1996
EP 0 146 683 A1 3/1985
EP 0 677981 A 10/1995
EP 0 707 438 A 4/1996
EP 0 748 146 A1 12/1996

* cited by examiner

*Primary Examiner*—David Vu
(74) *Attorney, Agent, or Firm*—Fitzpatrick, Cella, Harper & Scinto

(57) ABSTRACT

An electronic ballast for at least one low-pressure discharge lamp contains an inverter which is connected to a direct-voltage source ($U_{BUS}$), a load circuit which is connected to the inverter and contains the lamp (LA) and a series resonant circuit, and an evaluating circuit arrangement (M1) which reacts to different operating states of the lamp (LA) and in the case of a defect or removal of the lamp (LA) generates corresponding signals for switching off the inverter. A heating transformer, for heating the coils (W1, W2), the primary winding (Tp) of which is connected in series with a switch (S3) to the output of the inverter and in any case is connected to the direct-voltage source ($U_{BUS}$) if the inverter is switched off on account of the heating-coil defect or the removal of the lamp (LA), with the switch (S3) being clocked in this off-phase.

15 Claims, 2 Drawing Sheets

ELECTRONIC BALLAST FOR AT LEAST ONE LOW-PRESSURE DISCHARGE LAMP

CROSS REFERENCE TO RELATED APPLICATIONS

This is a Continuation of copending International Application No. PCT/EP00/03572, filed Apr. 19, 2000 and published in German, but not in English, on Nov. 30, 2000, the priority of which is claimed.

BACKGROUND OF THE INVENTION

Field of the Invention

The present invention relates to an electronic ballast for a low-pressure discharge lamp having an inverter which is arranged to be connected to a direct current voltage source, a load circuit which is connected to the inverter and which is configured to contain a lamp and a series resonant circuit, and also including an evaluating circuit arrangement which reacts to different operating states of a lamp and in the case of a defect or removal of such lamp, generates corresponding signals for switching off the inverter and that has a circuit arrangement for identifying a lamp change or a lamp defect.

A ballast having such a circuit arrangement is known, for example, from EP 0 146 683 B1. The resonant capacitor of the series resonant circuit in this case is arranged between the two electrodes of the discharge lamp, thereby making it possible for the electrodes to be preheated before the lamp is ignited. Furthermore, the ballast has a bistable switching device with an operating state and an off-state, with the switching device, in the case of a non-igniting discharge lamp, tripping into the off-state and switching off the inverter. The function of this circuit arrangement is based on the fact that the amplitude of the current flowing by way of the load branch with the lamp in the case of a lamp that is not ignited is substantially greater than in the case of a lamp that is ignited. A holding-current circuit that is run by way of one of the electrodes of the discharge lamp then holds the bistable switching device in this off-state for so long until it is interrupted by the insertion of a new lamp, thereby automatically initiating a restart of the lamp.

A disadvantage of this circuit arrangement though lies in the fact that even after the ignition of the lamp a parallel current flows by way of the resonant capacitor and by way of the two coils of the lamp. During normal operation of the lamp this parallel current signifies lost energy and impairs the lamp's illuminating power or the degree of efficiency. Furthermore, in the case of this ballast it is not possible to regulate the heat output independently of the lamp current, something which can be regarded as being disadvantageous in particular during a dimmed operation of the lamp, since the reduction in current brought about by the dimming should be compensated for by the coil heating.

SUMMARY OF THE INVENTION

It is therefore the object of the present invention to specify an electronic ballast for a low-pressure gas discharge lamp in which in the switched-off state of the inverter the state of the lamp and in particular a change of the lamp is detected with the least possible outlay and which, in comparison with the prior art, renders possible better control of the heating of the lamp coils.

This object is achieved by means of a ballast which has a heating transformer for coils of a lamp and connected in the lamp load circuit, a primary winding of the heating transformer being connected in series with a switch to an output of the inverter and being arranged to be connected to a direct current voltage source when the inverter is switched off on account of a heating coil defect or removal of a lamp, the switch being clocked during its switched off phase and the evaluating circuit being arranged to evaluate current that flows through at least one winding of the heating transformer. The ballast in accordance with the invention is distinguished in that provided for the purpose of heating the coils there is a heating transformer, the primary winding of which is connected in series with a switch to the output of the inverter. The current in the primary winding is transmitted to two secondary windings which, in each case with one of the two coils, form a heating circuit. In this connection, the current flowing through the primary winding is detected by means of an evaluating circuit arrangement which in the case of a defect of at least one of the two coils or in the event of the removal of the lamp or in the case of a defect of the lamp detected by further evaluating circuit arrangements causes the inverter to be switched off. In this case, even in the switched-off state of the inverter the primary winding of the heating transformer is connected to a direct-voltage source, in this off-phase the switch that is connected in series with the primary winding is clocked, and by means of the evaluating circuit arrangement the current flowing through the primary winding and/or the secondary winding(s) of the heating transformer is evaluated. This current is substantially dependent upon whether a lamp is in the system or whether its two coils are intact. The heating transformer steps down the heating voltage towards the lamp to a great extent so that the levels of coil resistance for their part are stepped up towards the primary winding. Evaluation of the flow of the current accordingly does not only give information on whether a lamp is inserted, but in addition also on whether and, if this is the case, which coil is defective. If in the off-phase the defective lamp is replaced by a new one, this is identified by the evaluating circuit arrangement which then automatically initiates a restart of the lamp.

In comparison with the ballast of EP 0 146 683 B1, a substantially higher degree of efficiency is attained for the lamp, since by opening the switch the coil heating can be completely switched off after the lamp has been ignited and thus no leakage currents occur. furthermore, the heat output can be regulated by temporarily closing the switch.

Further developments of the invention are described and claimed herein. The current-valuation is effected most simply by measuring the voltage drop across a measuring resistor that is connected in series with the primary winding. Furthermore, the series circuit arrangement consisting of the primary winding and the switch can be connected to a charging/discharging capacitor, with the amplitude of the measured current of the resultant charging or discharging curves being evaluated in its time characteristic or at specific instants in order to detect the state of the lamp.

The flow of current in the heating transformer or the voltage drop across the measuring resistor respectively depends inter alia as well upon the direct voltage that is fed to the heating transformer. However, this can change quite easily over time—for example on account of mains fluctuations. In a further development of the invention therefore a second measuring resistor can be provided in a heating circuit which consists of a lamp coil and the pertinent secondary winding, with the voltage that drops across this measuring resistor likewise being evaluated. A comparison of the two voltages then permits a statement to be made on the state of the electrodes of the lamp independently of voltage fluctuations. This is effected, for example, by forming the differential voltage which is then compared with a rated value. As will be shown, this method allows a very simple, yet meaningful analysis to be made of the state of the lamp. Alternatively, however, the flow of current in the heating transformer at respective specific instants can also be compared with an earlier measured value or a reference value. In this case, just one single measuring resistor would be sufficient, with it being possible to evaluate the current selectively in the primary winding or in one of the two secondary windings.

The use of a heating transformer is already known from EP 0 707 438 A3 or from EP 748 146 A1 and DE 295 14 817 U1, in which here as well in each case there is mention of the coil heating being switched off after the ignition of the lamp. Furthermore, EP 0 707 438 A3 provides for the heating current to be evaluated in order to identify possible lamp defects. However, in none of the cases of the ballasts described in these specifications is it provided that the inverter be switched off and the change of a lamp be identified. The invention is also suitable for use for electronic ballasts which operate a plurality of lamps.

BRIEF DESCRIPTION OF THE DRAWINGS

The invention shall be explained in greater detail in the following with reference to the enclosed drawing in which.

DETAILED DESCRIPTION OF THE PREFERRED EMBODIMENTS

Figure 1:
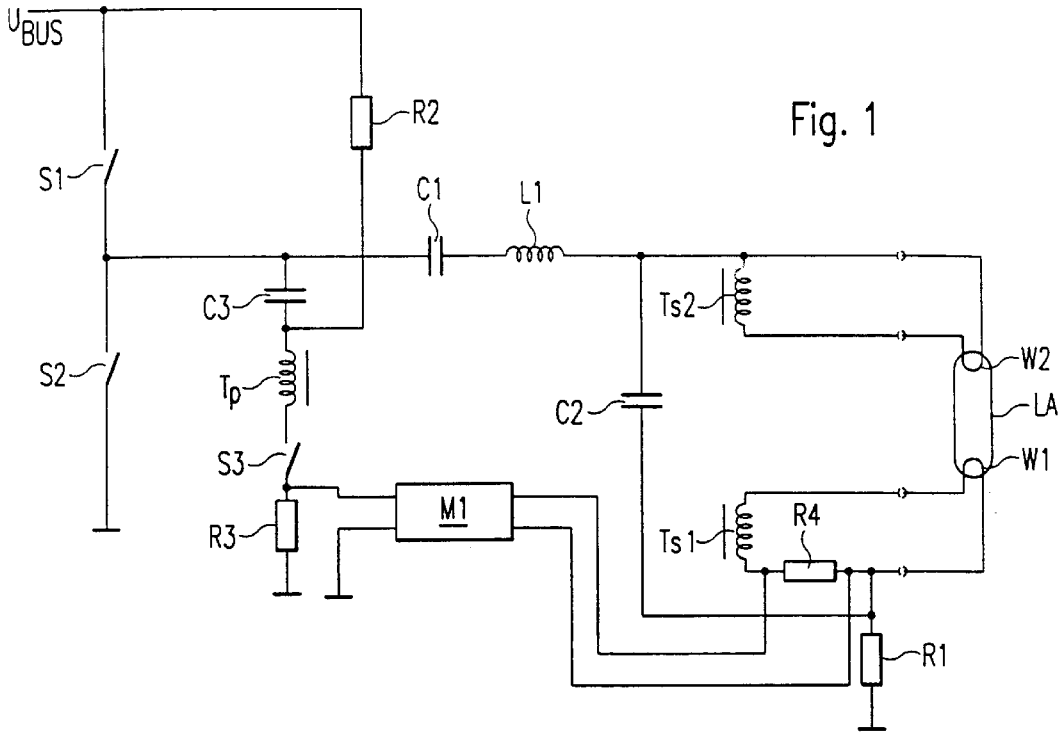
FIG. 1 shows an exemplary embodiment of a circuit arrangement in accordance with the invention for activating the lamp and for detecting the state of the lamp.

The important component parts of the invention are shown in the circuit diagram in FIG. 1. The inverter is formed by a half-bridge consisting of two electronic switches S1 and S2 which are connected in series. These switches S1, S2 can, for example, be formed by two MOS field-effect transistors. The base of the half-bridge is connected to ground, whilst the direct voltage UBUS, which can be generated, for example, by shaping the usual mains voltage by means of a combination of radio-interference suppressors and rectifiers, is applied to its input. As an alternative to this, however, any other direct-voltage source can also be applied to the half-bridge.

The load circuit, which contains the discharge lamp LA, is connected to the common nodal point of the two switches S1 and S2. Said load circuit consists of a series resonant circuit which is composed of an inductance coil L1 and a resonant capacitor C2. A coupling capacitor C1 is connected upstream of the inductance coil L1. Furthermore, the upper cathode of the two cathodes of the lamp LA is connected to the connecting node between the inductance coil L1 and the resonant capacitor C2. The two cathodes each have two terminals, provided between which there is a respective heating coil W1 and W2 for heating the cathodes. The lower cathode of the lamp LA is in turn connected to the output of the resonant capacitor C2 and finally the common nodal point is connected to ground by way of the resistor R1.

For the purpose of preheating the two coils W1 and W2, a heating transformer is provided that consists of a primary winding Tp and also of two secondary windings Ts1 and Ts2. The secondary windings Ts1 and Ts2 are each connected to a coil W1 and W2 respectively of the lamp LA so that two separate heating circuits are formed. The primary winding Tp is arranged in the centre of a series circuit arrangement which in addition to the primary winding Tp has a charging/discharging capacitor C3 and a third controllable switch S3. This switch S3 as well, like the two switches of the half-bridge S1 and S2, can consist of a field-effect transistor. The second terminal of the charging/discharging capacitor C3, just like the load circuit, is connected to the nodal point of the two switches S1 and S2 so that this series circuit arrangement is connected in parallel with the lower branch of the half-bridge. The direct supply voltage $U_{BUS}$ is additionally fed to the nodal point between the primary winding Tp and the charging/discharging capacitor C3, independently of the inverter, by way of a resistor R2.

A measuring resistor R3 is arranged between the switch S3 and the ground terminal of the series circuit arrangement for the detection of the heating current. The voltage drop brought about by the current across the measuring resistor R3 is measured with the aid of an evaluating circuit arrangement M1. A further measuring resistor R4 is arranged in the heating circuit of the lower lamp coil W1, in which case the voltage drop across this measuring resistor R4 and thus the current flow through this heating circuit can also be measured by means of the evaluating circuit arrangement M1.

Since the two measuring resistors R3, R4 are used indirectly for current measurements, they can of course also be arranged at different positions. For example, the first measuring resistor R3 can also be provided between the switch S3 and the primary coil Tp of the heating transformer, or the second measuring resistor R4 can be located on the other side of the secondary coil Ts1 in the heating circuit. As an alternative to being located in the lower heating circuit, this resistor R4 can, however, also be located in the heating circuit of the upper coil W2 and the second secondary coil Ts2. Since the current intensities are required for the detection of the state of the lamp, other current-measuring devices can also be used instead of the measuring resistors R3 and R4.

The three switches S1, S2 and S3 are activated by means of a control circuit arrangement which is not shown, with the preheating of the coils W1, W2 and the ignition of the lamp LA being carried out in a known manner. During the preheating, the third switch S3 is permanently closed so that the alternating voltage supplied from the inverter is also fed to the heating transformer. In this case, the switches S1 and S2 are activated with a frequency that is raised in relation to the resonant frequency of the load circuit so that the voltage that is applied to the lamp LA does not yet give rise to any ignition. At the end of a predetermined heating time, the switch S3 is opened and the heating of the coils is thus brought to an end and the ignition of the lamp LA is initiated. For this purpose, the alternating voltage frequency of the control signals for the two switches S1 and S2 of the inverter is approximated to the resonant frequency until ignition is finally effected.

Whilst the lamp LA is being preheated, with the aid of the evaluating circuit arrangement or other monitoring circuit arrangements (not shown) it is already possible to check in a known manner whether an intact lamp LA is located in the system. If this is not the case or if during preheating or during normal operation a coil-break or removal of the lamp LA is recorded, the ballast is put into a state of rest and the inverter is switched off in order to consume as little energy as possible and to make it possible to exchange the lamp LA safely. However, for this the switch S3 pertaining to the coil heating is clocked at a low frequency. Since the supply voltage UBUS is fed to the primary winding Tp by way of the resistor R2, by clocking the switch S3 an alternating voltage is generated that is transmitted by means of the transformer to the two heating circuits with the coils W1 and W2. The heating current through the primary winding Tp is then detected by means of the evaluating circuit arrangement M1 in order to ascertain whether a new intact lamp has been inserted. In this connection, the switch S3 is preferably switched at a low clock frequency of approximately 50–100 Hz. The pulse duty factor of the control signal for the switch S3 lies at approximately 50%, although in this case neither the choice of the clock frequency nor the pulse duty factor is critical for the detection of the state of the lamp.

The evaluation of the voltage signals $U_{R3}$ and $U_{R4}$ tapped at the measuring resistors R3 and R4 shall be explained 20 in greater detail in the following with reference to FIG. 2. For this, considerations are based on the fact that in the switched-off-state of the inverter, the upper switch S1 is permanently open, whilst, on the other hand, the lower switch S2 is closed. The switch S3 opens and closes with a frequency of approximately 50 Hz. With the opening of the switch S3, the charging/discharging capacitor C3 is charged by the voltage $U_{BUS}$ by way of the resistor R2. The voltage characteristic of a rising e-function then results at the charging/discharging capacitor C3. If the switch S3 is subsequently closed, this leads to a discharge of the charging/discharging capacitor C3, with the voltage, viewed over time, now following a falling e-function.

Each time the switch S3 is closed, at the primary coil Tp of the heating transformer on account of the discharge of the charging/discharging capacitor C3 a current pulse results and accordingly at the measuring resistor R3 a voltage pulse UR3 results. The voltage characteristic at the measuring resistor R3 substantially depends upon whether a lamp LA is located in the system and whether the two coils W1 and W2 are intact. The transformer steps down the heating voltage towards the lamp to a great extent so that the levels of resistance of the two coils W1 and W2 for their part are stepped up towards the primary winding Tp. The behaviour of the primary winding Tp is therefore affected by two parallel levels of resistance that correspond to the two coils W1 and W2 respectively. If one of the two coils is broken or if the lamp LA has been removed, the behaviour of the primary winding Tp and thus the characteristic of the current pulse change.

Figure 2A:
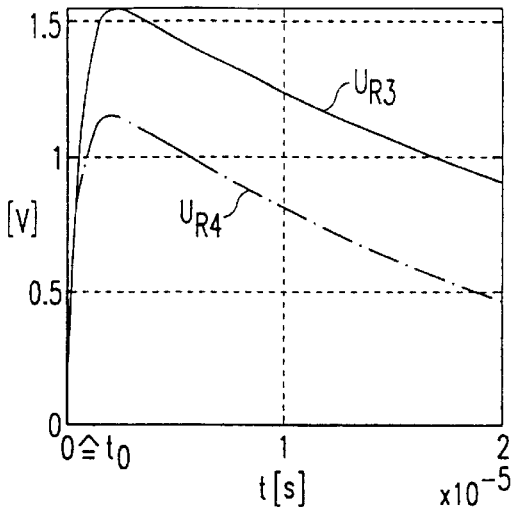
FIG. 2*a* shows the voltage characteristics at the two measuring resistors in the case of an intact lamp.
Figure 2B:
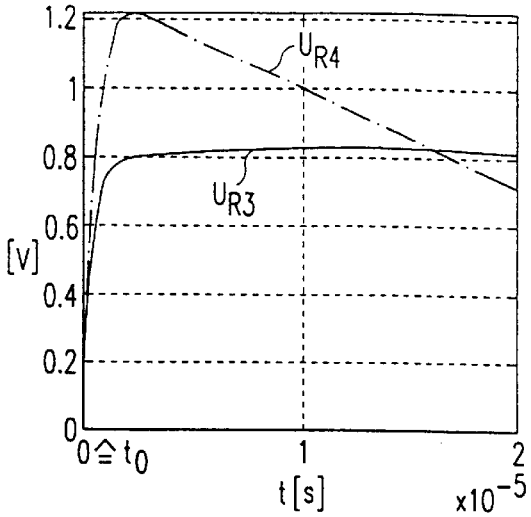
FIG. 2*b* shows the voltage characteristics at the two measuring resistors in the case of a defective lamp.

A typical voltage signal $U_{R3}$ that can be tapped at the measuring resistor R3 is shown in FIGS. 2*a* and 2*b*. The two graphs show the voltage characteristic that results after the closure of the switch S3, FIG. 2*a* showing the characteristic for an intact lamp and FIG. 2*b* showing the characteristic for the case where one of the two coils is broken. As can be inferred from FIG. 2*a,* after the closure the voltage $U_{R3}$ rises very quickly for a short time and thereupon after approximately 3 $\mu$s falls again. In contrast with this, when a coil is broken the voltage rise $U_{R3}$ is substantially only half as great and the subsequent voltage drop lasts substantially longer. The curves shown in the two graphs represent signal characteristics which result in the case of a commercially available gas discharge lamp.

Basically, already merely with the aid of the signal $U_{R3}$ a statement can therefore be made as to whether a lamp has been inserted and whether as well this is intact. However, the results of measurement of the voltage $U_{R3}$ also depend inter alia upon the supply voltage $U_{BUS}$. Fluctuations in $U_{BUS}$ could therefore possibly lead to an impairment in the measurement result and to a false statement being made on the state of the lamp LA, whereby a restart of the lamp which is still defective could be attempted by mistake.

In a further development therefore the voltage characteristic $U_{R4}$ is additionally detected at the second measuring resistor R4. Typical curves of $U_{R4}$ are likewise shown in FIGS. 2*a* and 2*b* for an intact lamp and for a lamp in which the upper coil is broken. In the case of an intact lamp, the voltage signal $U_{R4}$ at the second measuring resistor R4 differs from the signal $U_{R3}$ at the first measuring resistor R3 in the first place on account of the amplitude of the voltage pulse. The time characteristic, however, is similar. $U_{R3}$ likewise rises very quickly and then after approximately 3 $\mu$s falls again somewhat more slowly. In contrast, the signals $U_{R3}$ and $U_{R4}$ differ very distinctly when a coil is broken. The voltage $U_{R4}$ namely rises, as before, at the beginning to a very great extent and can then even attain distinctly higher values than $U_{R3}$. Subsequently, however, the signal $U_{R4}$ falls more quickly than $U_{R3}$ and after a certain time again attains lower values than $U_{R3}$.

Figure 2C:
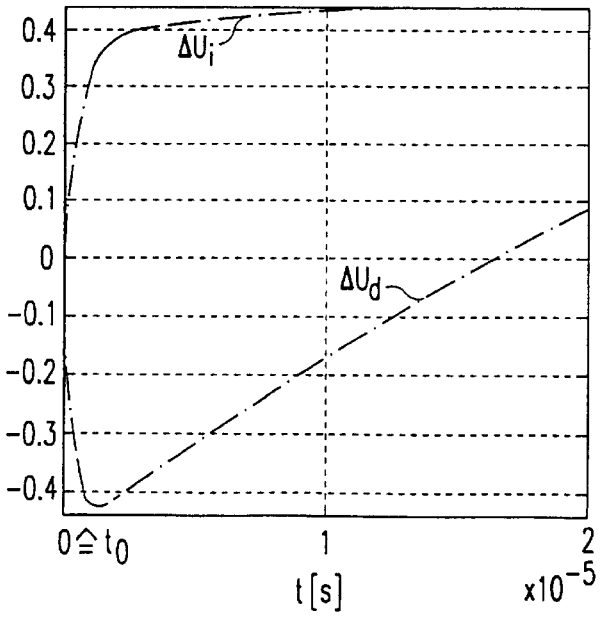
FIG. 2*c* shows the characteristic of the differential voltage in the case of an intact lamp and in the case of a defective lamp.

In order to be able to make a statement on the state of the lamp independently of fluctuations in the supply voltage $U_{BUS}$, the measurement results at the measuring resistors R3 and R4 are considered in their relationship with one another. In the simplest manner this takes place by forming and evaluating the differential voltage $\Delta U = U_{R3} - U_{R4}$. The result of the subtraction is shown in FIG. 2*c*. The curve $\Delta U_i$ then shows the differential signal that results from the two curves shown in FIG. 2*a* in the case of an intact lamp, whilst the curve $\Delta U_d$ is obtained in the case of a coil that is broken. These curves are now independent of fluctuations in the supply voltage $U_{BUS}$ and thus in a simple manner allow an unambiguous statement to be made on the state of the lamp. If the lamp is intact, the voltage difference $\Delta U_i$ is positive at each instant. If, however, the upper coil W2 is broken, $\Delta U_d$ assumes negative values for a short time. For example, up to 15 $\mu$s after the closure of the switch S3 the difference between $\Delta U_i$ and $\Delta U_d$ amounts to more than 400 mV, whereby the two states can also be distinguished with the aid of comparatively simple measuring devices. Even deviations from the ideal case, which as a result of a rise in temperature of the coils could thus lead to a change in the resistance values, are only so great that in each case a measuring tolerance of almost 100 mV remains. The state of the lamp is then assessed in a simple manner in that the two voltages $U_{R3}$ and $U_{R4}$ are measured in a specific window in time or at a fixed instant—for example 10 $\mu$s—after the closure of the switch S3, the differential voltage $\Delta U$ is formed and the latter is fed to a comparator located in the evaluating circuit arrangement M1 that compares $\Delta U$ with a reference or rated value.

Furthermore, the use of the second measuring resistor R4 gives information on which of the two coils of the lamp is broken. If it is namely the lower coil W1, inevitably no voltage at all occurs at R4, since the lower heating circuit is not closed. This is also the case if the lamp has been completely removed. Thus by evaluating the two voltage signals $U_{R3}$ and $U_{R4}$ it is possible to distinguish very simply between all of the four possible states of the lamp (intact lamp, upper or lower coil broken, no lamp present). Voltage measurements at the two measuring resistors R3 and R4, however, are not the only possibility. The application of all other types of current-measuring methods with which the current pulses in the primary coil Tp and one of the two coils W1 or W2 respectively can be evaluated would also be possible.

A further possibility of identifying the re-insertion of an intact lamp lies in dispensing with the second measuring resistor R4 and the measurement of the current through one of the two coil-heating circuits and instead of this only considering the voltage signal $U_{R3}$. If a change occurs with regard to the lamp, if therefore, for example, a new lamp is inserted, in each case this gives rise to a change in the signal $U_{R3}$. It is now possible to store a voltage value $U_{R3}$ that is measured at the measuring resistor R3 at a specific instant after the closure of the switch S3 or a rated value that is already known and to compare the later currently occurring measured values of $U_{R3}$ with the stored value. In turn, a simple comparator is required for this, for example. If an intact lamp is inserted, this is identified immediately. The structure of the detecting and evaluating circuit arrangement M1 is simplified even further since it is only necessary to conduct the measurement at only single resistor. A further possibility of identifying the re-insertion of a lamp lies in dispensing with the measuring resistor R3 and instead of this evaluating just the voltage drops across one or both secondary windings, for example by means of the voltage signal $U_{R4}$.

If finally it is ascertained that an intact lamp is located in the system again, a corresponding signal can be transmitted from the evaluating circuit arrangement M1 to the control circuit arrangement in order to induce an automatic restart.

Figure 3:
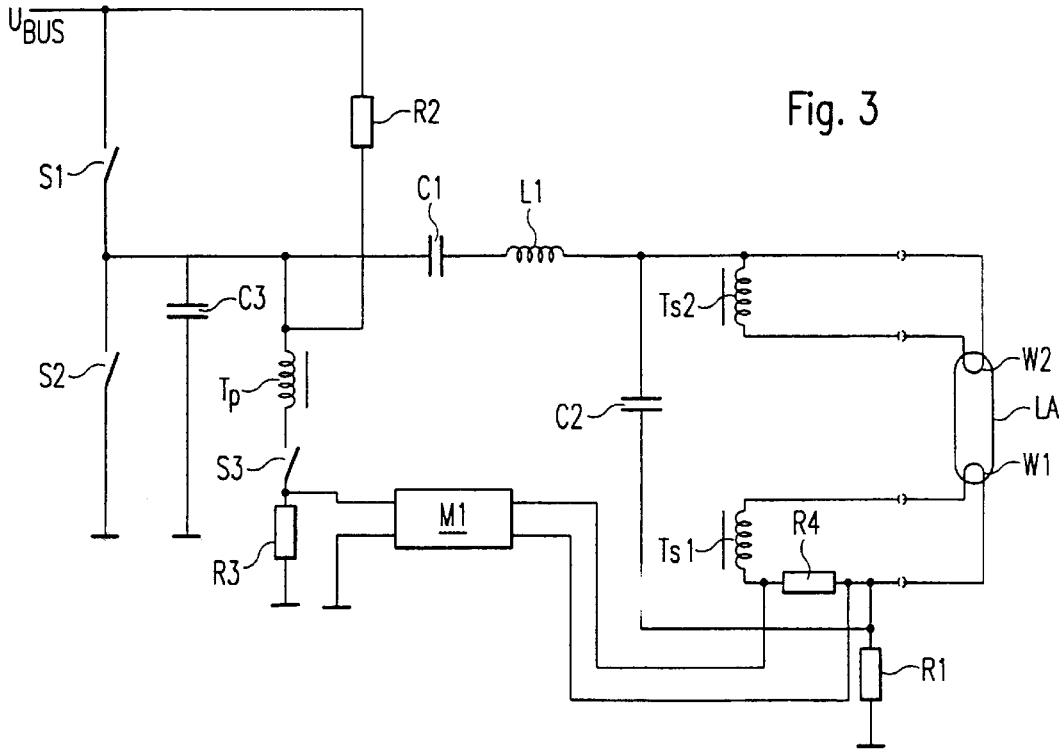
FIG. 3 shows an alternative circuit arrangement to the exemplary embodiment shown in FIG. 1.

Another alternative to the circuit arrangement shown in FIG. 1 is to be mentioned in conclusion. The charging/discharging capacitor C3 namely need not necessarily be located at the position shown in FIG. 1. In order nevertheless to obtain a charging or discharging curve, in accordance with the alternative circuit arrangement shown in FIG. 3 the charging/discharging capacitor C3 can, for example, also be connected to the nodal point of the two switches S1 and S2 of the inverter at one end and directly to ground at the other end.

What is claimed is:

1. In an electronic ballast for at least one low-pressure discharge lamp, an inverter which is connectable to a direct-voltage source, a load circuit which is connected to the inverter and which is configured to contain a lamp and which includes a series resonant circuit, an evaluating circuit arrangement constructed and connected to react to different operating states of such lamp and, in the case of a defect or removal of the lamp, to generate corresponding signals which are used to switch off the inverter, a heating transformer connectable to coils of such lamp, a primary winding of said transformer being connected in series with a switch to an output of said inverter and being connectable to a direct-voltage source if said inverter is switched off on account of a heating-coil defect or removal of the lamp, said switch being clocked in the switched-off condition of said inverter, said evaluating circuit being arranged to evaluate current that flows through at least one of said primary winding and said secondary winding of said heating transformer.

2. Electronic ballast according to claim 1, wherein:

a series circuit arrangement comprising said switch and said primary winding is additionally connectable to direct-voltage source independently of said inverter.

3. Electronic ballast according to claim 2, wherein:

a charging/discharging capacitor is connected to said series circuit arrangement comprising said switch and said primary winding, said evaluating circuit arrangement being constructed and connected to evaluate the amplitude of measured current in its time characteristic or at a specific instant in order to identify a lamp change or lamp defect.

4. Electronic ballast according to claim 3, wherein:

said charging/discharging capacitor is connected in series with said series circuit arrangement, and wherein this extended series circuit arrangement is connected in parallel with said load circuit.

5. Electronic ballast according to claim 3, wherein:

said charging/discharging capacitor is connected to an output of said inverter, and wherein said charging/discharging capacitor and said series circuit arrangement comprising said switch and said primary winding are connected in parallel with said load circuit.

6. Electronic ballast according to claim 3, wherein:

a nodal point between said primary winding and said charging/discharging capacitor is additionally connectable to a direct-voltage source, independently of said inverter, by way of a resistor.

7. Electronic ballast according to claim 1, wherein:

a measuring resistor is connected in series with said series circuit arrangement comprising of said switch and said primary winding, and wherein said evaluating circuit arrangement is configured to evaluate a voltage that is generated at said measuring resistor by current flowing through the latter.

8. Electronic ballast according to claim 1, wherein:

for the purpose of measuring current flowing through a lamp heating circuit, a further measuring resistor is provided to be connected to such lamp heating circuit, and wherein said further measuring resistor is connected to feed a voltage across said further measuring resistor to said evaluating circuit arrangement.

9. Electronic ballast according to claim 7, wherein:

said evaluating circuit arrangement is configured to form a differential voltage from voltages that drop across said measuring resistor and also across a further measuring resistor contained in a lamp heating circuit for evaluating said differential voltage.

10. Electronic ballast according to claim 9, wherein:

said evaluating circuit includes a comparator to which said differential voltage is fed, and wherein said comparator is connected to compare said differential voltage with a rated value.

11. Electronic ballast according to claim 7, wherein:

said evaluating circuit arrangement includes a comparator which is connected to compare a voltage dropping across a respective measuring resistor with a rated value in predetermined instants of time or in specific windows of time.

12. Electronic ballast according to claim 11, wherein:

said rated value is a voltage value that is measured at the respective measuring resistor at an earlier instant.

13. Electronic ballast according to claim 1, further comprising:

a rectifier that is connectable to a voltage supply which generates a direct voltage, and feeds same to said inverter.

14. Electronic ballast according to claim 11, wherein:

said inverter includes a half-bridge comprising two electronic switches connected in series, and wherein said load circuit containing a lamp is connected in parallel with said one of said two electronic switches.

15. Electronic ballast according to claim 1, wherein:

said load circuit includes an inductance coil, which is connectable in series with the lamp, and a resonant capacitor, said resonant capacitor being connected in parallel with said lamp.

* * * * *